United States Patent [19]

Mock et al.

[11] Patent Number: 4,561,077

[45] Date of Patent: Dec. 24, 1985

[54] WRIST WATCH HAVING A BRACELET ATTACHED TO THE WATCH CASING BY A HINGE

[75] Inventors: Elmar Mock, Bienne; Alphonse Bron, Bassecourt, both of Switzerland

[73] Assignee: ETA S.A., Fabriques d, E bauches, Grandes, Switzerland

[21] Appl. No.: 722,986

[22] Filed: Apr. 15, 1985

Related U.S. Application Data

[63] Continuation of Ser. No. 498,822, May 27, 1983, abandoned.

[30] Foreign Application Priority Data

Jun. 11, 1982 [CH] Switzerland ..... 3620/82

[51] Int. Cl.[4] ..... G04B 37/00

[52] U.S. Cl. ..... 368/282

[58] Field of Search ..... 368/276, 281–282, 368/300–304; 234/164, 167, 169, 174, 177, 179, 180

[56] References Cited

U.S. PATENT DOCUMENTS

| | | | |
|---|---|---|---|
| 2,012,965 | 9/1935 | Mathez | 368/282 |
| 2,191,020 | 2/1940 | Kaufmann | 368/282 |
| 2,219,277 | 10/1940 | Kaufmann | 368/282 |

FOREIGN PATENT DOCUMENTS

| | | | |
|---|---|---|---|
| 187471 | 11/1936 | Switzerland | 268/282 |
| 250701 | 6/1948 | Switzerland | 368/282 |
| 267737 | 5/1951 | Switzerland | 368/282 |
| 280560 | 5/1952 | Switzerland | 268/282 |
| 405170 | 9/1965 | Switzerland | 368/282 |

*Primary Examiner*—Vit W. Miska

*Attorney, Agent, or Firm*—Spensley, Horn, Jubas & Lubitz

[57] ABSTRACT

A wrist watch has a bracelet connected to the watch casing by hinges. Each hinge comprises four lugs which are formed in one piece with the peripheral casing portion and rim portion of the casing, the lugs defining therebetween three spaces which are each occupied by one of three hinge elements provided at one end of the adjacent bracelet half. The casing is made of plastics material. A metal pivot pin extends through holes formed in the elements.

9 Claims, 4 Drawing Figures

WRIST WATCH HAVING A BRACELET ATTACHED TO THE WATCH CASING BY A HINGE

This is a continuation of copending application Ser. No. 498,822 filed on May 27, 1983, now abandoned.

BACKGROUND OF THE INVENTION

The present invention concerns wrist watches having a bracelet attached to the watch casing by hinges.

The term "hinge" is used to denote a pivot connection between two components and comprising at least one first element fixed to one of the components, at least one second element fixed to the other component, and at least one third element forming a pivot member.

French Pat. No. 2 251 291 discloses such a wrist watch, wherein the hinges are each formed by an element which is fixed to the casing of the watch, and two elements which are fixed to the bracelet and which are spaced from each other, these two elements flanking the element which is fixed to the casing. A pivot pin passes through all three elements, thereby defining a pivotal axis.

Thus, in the known construction, each hinge comprises only a single element which is fixed with respect to the watch casing, that element taking up the space between the two elements which are fixed to the bracelet. The pivot pin subjects the hinge element which is fixed with respect to the watch casing not only to tensile stresses which are at right angles to the axis of the pin, but also to twisting stresses which are centered at the middle of the pin. Accordingly, this known construction cannot be applied to watch casings of plastics material, as plastics material generally has poor strength against twisting stresses.

In addition, Swiss Pat. No. 405 170 describes a wrist watch in which the bracelet is formed by a plurality of rigid elements, probably of metal, which are each held in contact with an adjoining rigid element, and non-rigidly connected to the latter. The end elements of the bracelet, which are adjacent to the watch casing, are welded to the casing and are attached to the adjacent bracelet elements by means of a pin. Such a construction, which therefore does not use hinges as defined hereinbefore, is also such that it cannot be applied to a casing of plastics material. In fact, the end elements of the bracelet, which are welded to the watch casing, are subjected to mechanical twisting stresses by the immediately adjoining bracelet elements to which they are non-rigidly connected and with which they are held in contact.

SUMMARY OF THE INVENTION

The main object of the present invention is therefore to provide a wrist watch in which the hinges connecting the bracelet to the casing of the watch are compatible with using a watch casing made of plastics material.

In accordance with the invention, at least the peripheral casing portion of the watch casing is made of plastics material and each hinge comprises n first mutually spaced elements (n being an integer greater than 2) which are formed in one piece with the peripheral casing portion, and n−1 second elements which are fixed with respect to the bracelet and which each occupy a space between two adjacent first elements.

By virtue of the above-indicated construction, the pivot member of the hinge in practice subjects the first elements only to tensile stresses which are at right angles to the pivotal axis.

In accordance with a preferred embodiment, each hinge comprises four first hinge elements which are formed integrally with the peripheral casing portion of the watch casing, and three second hinge elements which are formed integrally with the bracelet half adjoining the hinge, each of said elements having a through hole, all the holes being disposed in alignement and having a straight pivot member passing therethrough, the pivot member being a drive fit in the holes in the second elements while it is engaged with clearance in the holes in the first hinge elements.

BRIEF DESCRIPTION OF THE DRAWINGS

Other features and advantages of the invention will be more clearly apparent from the following description of an embodiment of the invention which is given by way of non-limiting example, with reference to the accompanying drawings in which.

DETAILED DESCRIPTION OF A PREFERRED EMBODIMENT

Figure 1:
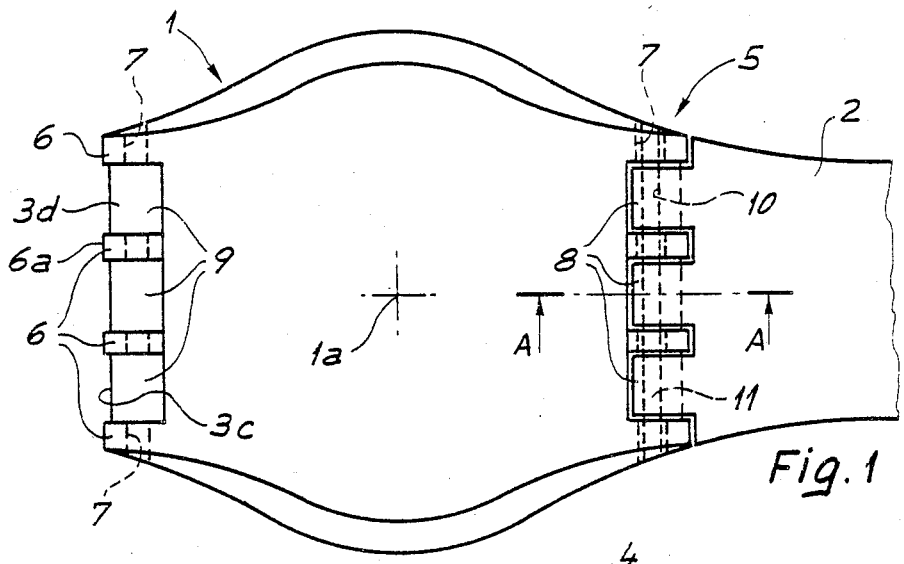
FIG. 1 is a plan view of part of a wrist watch according to the invention.

The wrist watch shown in the drawings comprises a watch casing 1 and a bracelet, of which only one bracelet half is shown, at 2. The casing 1 comprises a bottom or back 3*a*, and a peripheral casing portion 3*b* with a rim which retains a glass 4.

In the illustrated embodiment, the back 3*a* and peripheral portion 3*b* of the casing 1 are made of plastics material in one piece 3, referred to hereinafter as the casing body. In this embodiment, the glass 4 is made of a transparent plastics material and is fixed on the casing portion 3*b* in fluid-tight manner.

The casing body 3 is advantageously made from one of the following three plastics materials: that which is known as ABS (acryl butadiene styrene), that which is known as ASA (acryl styrene acrylester) and that which is known as SAN (styrene acrylonitrile), while the glass 4 may be made of a transparent acrylic resin such as that known under the trademark Plexiglas. The bracelet half 2 may be made either of an elastomer, or a plastics material such as PVC (polyvinyl chloride). The back 3*a* of the casing could be made of metal, set into the peripheral portion 3*b*.

As will be seen from the drawings, the bracelet half 2 is attached to the watch casing 1 by a hinge 5. The hinge 5 comprises an array of four first fixing elements or lugs 6 which are moulded with the casing body 3, the elements 6 being disposed in a side-by-side and spaced relationship and each having a through hole 7 of circular section, the holes 7 all being of the same diameter and being mutually aligned. The hinge 5 further comprises three second fixing elements 8 which are formed in one piece with the bracelet 2, each element 8 being respectively engaged in a space 9 defined between two adjacent first elements 6. Each element 8 has a through hole 10 of circular section. The holes 10 are aligned with each other and, when the elements 8 are set into the spaces 9, they are also aligned with the holes 7 in the first hinge elements 6. A straight metal rod or pin 11 of circular section passes through the aligned holes 7 and 10, to form the pivot member of the hinge. In order to prevent any tangential stress from being applied to the first hinge elements 6, the rod 11 is a drive or interference fit in the holes 10, while it is a free fit in the holes 7.

In order to hide the hinge elements 6 and 8, at its side towards the glass 4, the peripheral casing portion **3*b* is provided with a cover wall portion 3*c* which is of such a size as to overhang and mask the hinge elements 6 and 8**, when viewed from above.

The cover portion **3*c* which is formed by moulding with the casing body 3 connects the first hinge elements 6 together and thus contributes to enhancing the mechanical strength of the first hinge elements 6. The cover portion 3*c* has a free edge as shown at 3*d*, which is formed by a part of the external surface of the cover wall portion, that faces towards the back of the watch casing, the edge 3*d* being disposed at a position remote from the centre 1*a* of the watch casing 1. The free edge 3*d*, the cross-section of which is substantially in the form of a circular arc, lies substantially flush with the end 6*a* of the hinge elements 6, which is remote from the centre 1*a*** of the watch casing.

Figure 2:
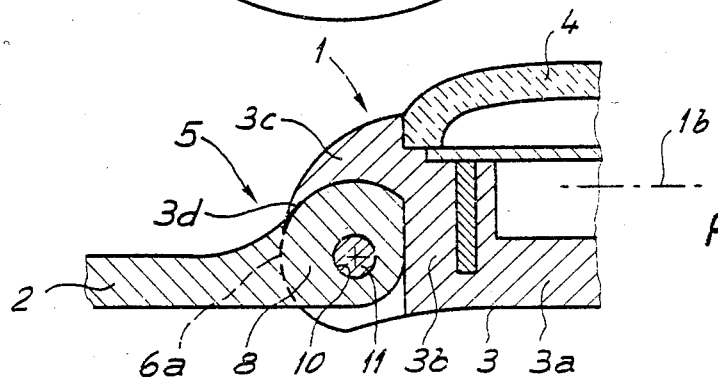
FIG. 2 is an elevational view of part of the wrist watch shown in FIG. 1, in vertical section taken along line A—A in FIG. 1.
Figure 3:
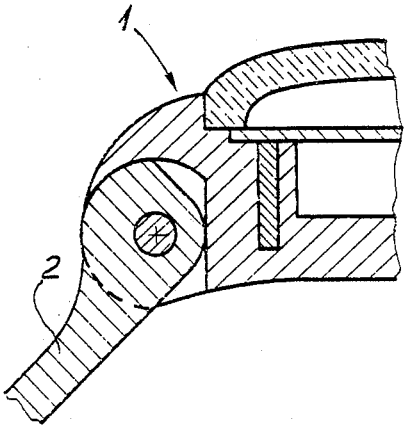
FIG. 3 is a similar view to that shown in FIG. 2, showing the bracelet half in a second angular position relative to the watch casing.
Figure 4:
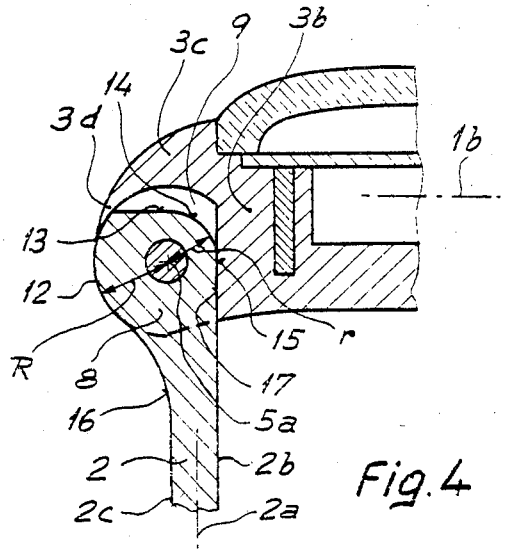
FIG. 4 is a similar view to that shown in FIG. 2, showing the bracelet half in a third angular position relative to the watch casing.

As will be better seen from FIGS. 2 to 4, transversely with respect to the hole 10, each second hinge element 8 is of a cross section, the periphery of which comprises a first arcuate portion 12 centered on the geometrical axis of rotation **5*a* of the hinge 5, a straight portion 13 substantially normal to the general plane 2*a* of the bracelet half 2, a second arcuate portion 14 which is also centered on the axis 5*a*, and a second straight portion 15 which constitutes an extension of the internal surface 2*b* of the bracelet half 2. The internal surface 2*b*** is the surface which is intended to be in contact with the wrist of the person wearing the watch.

The first arcuate portion 12 has a radius R that is substantially equal to the distance between the geometrical axis **5*a* of the hinge 5 and the free edge 3*d* of the cover portion 3*c*. That particular dimension avoids a space remaining between the elements 8 and the edge 3*d*, which is unattractive from the aesthetic point of view. The first arcuate portion 12 is connected to the upper surface 2*b* of the bracelet half 2, by a regular curve 16. At its opposite end, the arcuate portion 12 is connected to the substantially straight portion 13**.

The radius r of the second arcuate portion 14 is less than the radius R of the arcuate portion 12. The radius r is substantially equal to the distance between the geometrical axis **5*a* of the hinge 5 and an external and substantially flat surface 17 of the peripheral casing portion 3*b*, the surface 17 delimiting each space 9, in a direction towards the centre 1*a* of the casing 1. The second arcuate portion 14 is connected on the one hand to the first straight portion 13 and on the other hand to the second straight portion 15 of the cross section of an element 8. The straight portions 13 and 15 are spaced from the geometrical axis 5*a* by a distance substantially equal to r. Finally, in the illustrated embodiment, the two arcuate portions 12 and 14 of the cross section of an element 8** are each of an angular extent that is substantially equal to 90°.

By virtue of the particular configuration of the hinge elements 8 and the particular configuration, as shown in the drawings, of the wall portions defining the spaces 9, the bracelet half 2 can be pivoted relative to the watch casing 1 through a maximum angle of 90° from a first limit position as shown in FIGS. 1 and 2, in which the bracelet half 2 extends parallel to and substantially in the line of the general plane **1*b* of the casing 1, to a second limit position as shown in FIG. 4, in which the bracelet half 2 extends substantially perpendicularly to the general plane 1*b* of the casing 1. The bracelet half 2 is stopped in its first limit position by the flat surface 13 (defined by the cross-sectional portion 13), coming into a position of abutment with the external surface 17. The bracelet half 2 is stopped in its second limit angular position by the flat surface 15 (defined by the cross sectional portion 15), coming into a position of abutment with the surface 17** which thus forms a counter-abutment means.

It will be appreciated that the invention is not limited to the embodiment described hereinbefore with reference to FIGS. 1 to 4 but that in contrast it extends to any other embodiment which falls within the scope of the principle defined by the claims accompanying this description. In particular, it would be possible for the pivot member 11 not to be a drive fit in the holes 10 in the hinge elements 8, but to be simply held axially in the holes 10 by any suitable means. For example, in the portions of the member 11 which are disposed in the holes 10, the member 11 may be smaller in diameter than the diameter of the portions thereof that are fitted in the holes 7 in the first hinge elements 6. If in addition the diameter of the holes 10 is smaller than the diameter of the abovementioned portions of the member 11, the annular steps which are thus formed between the parts of the axis member 11 which are of different diameters act as means for axially stopping the member 11 with respect to the second hinge elements 8.

What is claimed is:

1. A wrist watch including:

a casing comprising a back, a glass and a peripheral casing portion which is made of a plastics material, having a side wall which is substantially orthogonal to said back;

two arrays of n first fixing elements projecting from said side wall and forming an integral part of said peripheral casing portion, the first elements of each array being disposed in a side-by-side relationship to form n−1 first spaces therebetween, each first element being provided with a hole therethrough, the holes of the n first elements of the same array being aligned along an axis parallel to said back;

wherein said peripheral casing portion includes two masking wall portions which project from said side wall, one masking wall portion being connected to the first elements of one of said arrays, the other masking wall portion being connected to the first elements of the other of said arrays, said masking wall portions being integral with said peripheral casing portion and being disposed between said first elements and said glass, each first space thus being partially defined by two adjacent first elements, by a portion of said side wall, and by a portion of the external surface of one of said masking wall portions, which faces towards said back;

two bracelet halves made of a plastics material, each having an internal surface, an external surface and an end for fixing to said casing;

n−1 second fixing elements projecting from said fixing end of each bracelet half to be engaged into said n−1 first spaces of a respective array, said n−1 second elements being disposed in a side-by-side relationship to form therebetween n−2 second spaces for receiving n−2 first elements of a given array, each second fixing element being provided with a hole, the holes of the n−1 second elements being aligned; and two pivot axis members, each axis member being engaged in the holes of the first elements of one of said arrays and in the holes of the second elements which are fixed with respect to one of said bracelet halves.

2. The wrist watch of claim 1, wherein each pivot axis member is engaged freely in the holes in said first elements of one of said arrays.

3. The wrist watch of claim 2, wherein each pivot axis member is an interference fit in at least one of the holes of the second elements of one of said arrays.

4. The wrist watch of claim 1, wherein each of said second fixing elements has, perpendicularly to the axis of the hole therein, a cross section whose periphery, at the side adjacent to said external surface of the bracelet half, has a first portion in the form of a circular arc which is centered on the axis of said hole and whose radius is substantially the distance between said axis of rotation and said external surface portion of said masking wall portion, and at least one of said second elements also has abutment means co-operating with counter-abutment means fixed with respect to the casing, to define first and second limit positions in respect to rotary movement of the bracelet half with respect to the casing, said two limit positions being angularly spaced from each other by an angle which is at least equal to the angle associated with said circular arc.

5. The wrist watch of claim 1, wherein n is 4.

6. The wrist watch of claim 1, wherein said back and said peripheral portion of the watch casing are in one piece and comprise plastics material.

7. The wrist watch of claim 1, wherein said peripheral casing portion is made of a plastics material selected from the group consisting of ABS (acryl butadiene styrene), ASA (acryl styrene acrylester) and SAN (styrene acrylonitrile).

8. The wrist watch of claim 7, wherein the glass of the watch casing is made of plastics material and is sealingly fixed to said peripheral casing portion.

9. The wrist watch of claim 1, wherein said second fixing elements are formed integrally with the bracelet half, from the end of which they project.

* * * * *